United States Patent [19]

Walls et al.

[11] 4,416,972

[45] Nov. 22, 1983

[54] ELECTROLYTIC GRAINING OF ALUMINUM WITH NITRIC AND BORIC ACIDS

[75] Inventors: John E. Walls, Annandale; Robert L. Dragon, Hazlet; Thomas A. Dunder, High Bridge, all of N.J.

[73] Assignee: American Hoechst Corporation, Somerville, N.J.

[21] Appl. No.: 277,512

[22] Filed: Jun. 26, 1981

[51] Int. Cl.[3] ..... G03C 1/94; C25F 3/04

[52] U.S. Cl. ..... 430/278; 204/27; 204/33; 204/38 A; 204/129.75; 428/469

[58] Field of Search ..... 204/33, 38 A, 129.1, 204/129.75, 27, 17, 141.5; 428/469; 430/278, 302, 323, 327

[56] References Cited

U.S. PATENT DOCUMENTS

| | | | |
|---|---|---|---|
| 2,946,683 | 7/1960 | Mellan et al. | 430/161 |
| 3,106,499 | 10/1963 | Kendall | 156/21 |
| 3,160,506 | 12/1964 | O'Connor et al. | 430/161 |
| 3,980,539 | 9/1976 | Lloyd et al. | 204/129.75 |
| 4,072,589 | 2/1978 | Golda et al. | 204/129.4 |
| 4,166,015 | 8/1979 | Raether | 204/129.75 |

OTHER PUBLICATIONS

Metal Finishing Guidebook and Directory 1978, Metals and Plastics Publications, Inc., Hackensack, N.J., pp. 496.

*Primary Examiner*—Winston A. Douglas
*Assistant Examiner*—William Leader
*Attorney, Agent, or Firm*—Richard S. Roberts

[57] ABSTRACT

Aluminum is electrolytically grained in an aqueous solution of nitric and boric acids to provide a surface structure suitable for use as part of a lithographic printing plate. The electrolyte may also optionally contain hydrogen peroxide and/or aluminum nitrate.

11 Claims, No Drawings

ELECTROLYTIC GRAINING OF ALUMINUM WITH NITRIC AND BORIC ACIDS

BACKGROUND OF THE INVENTION

The present invention relates to electrolytic graining, particularly the electrolytic graining of aluminum sheets so as to provide the sheet with a surface suitable for use as part of a lithographic printing plate.

It has long been known to be advantageous to form a printing plate by coating a lithographically suitable photosensitive composition on to the surface of an aluminum sheet substrate for subsequent exposure to light through a mask with eventual development. The oleophilic image areas which remain accept and transfer ink during the printing process and the hydrophilic non-image areas accept water or aqueous solutions during printing to repel such greasy inks.

It has long been known that if the surface of the aluminum substrate were grained, either mechanically, for example by use of wire brushes or particulate slurries, or electrochemically by use of electrolytic solutions of acids such as nitric acid that the printing life of a plate may be substantially extended.

Electrolytic graining of aluminum and the electrolytic process has many advantages over mechanical graining. (See, for example, U.S. Pat. Nos. 3,072,546 and 3,073,765). For certain applications, a very fine and even grain is desired. For example, when the aluminum is to be used as a support for lithographic printing plates such characteristics are especially advantageous. A fine and even grain can be obtained in an electrolyte consisting of an aqueous solution of hydrochloric acid but the current density employed must be kept quite low or pitting of the aluminum surface will take place and, as a result of the low current density, it requires a relatively long period to complete the graining.

French Pat. No. 2,110,257 describes a process for electrolytic graining of aluminum in which the graining is carried out at a current density of 0.5 to 10 A/dm$^2$(amperes per square decimeter) in an aqueous electrolyte solution containing 0.5 to 2 percent by weight of hydrochloric acid and 0.1 to 1.5 percent by weight of boric acid. This process provides a fine and even grain but it is relatively slow with the time required for graining typically being about 5 minutes, or longer. According to this patent, the use of concentrations of hydrochloric acid or boric acid above 2 percent, or the use of a current density exceeding 10 A/dm$^2$, yields a coarse and irregular surface that is not suitable for use in lithographic printing.

SUMMARY OF THE INVENTION

The present invention provides an aluminum substrate with a finely grained surface substantially free of pitting which firmly anchors photosensitive coatings thereto, yet allows the removal of non-image areas of a printing plate during development. It furthermore allows sufficient surface wetting by aqueous solutions during the printing process so as to prevent the adherance of greasy inks to its surface.

To this end, the invention comprises a method of treating the surface of a sheet of aluminum or the alloys thereof which comprises electrolytically graining said sheet, under electrolyzing conditions, in an aqueous solution of nitric acid and boric acid in a sufficient concentration and for a sufficient length of time to provide a finely grained surface topography to said sheet.

DETAILED DESCRIPTION OF THE PREFERRED EMBODIMENT

The process of this invention comprises electrolytically graining aluminum in an aqueous electrolyte solution containing nitric acid and boric acid with concentrations of nitric acid and bore acid sufficient that a fine even grain that is substantially free from pits is obtained. The optimum concentrations of the nitric acid and boric acid will depend upon such factors as the exact current density employed, the temperature of the electrolyte solution, the properties of the aluminum article being grained, and so forth, and can be readily determined by a few simple experiments.

Optionally the electrolytic solution may contain hydrogen peroxide and/or aluminum nitrate.

The preferred concentration of nitric acid ranges from about 3 to 20 grams per liter, more preferably 8 to 20 grams per liter, most preferably 10 to 15 grams per liter. Above about 20 grams per liter, no significant etching difference is noted until about 500 grams per liter is reached, at which point etching power begins to decrease. The preferred concentration of boric acid ranges from about 1 gram per liter to about the saturation point, more preferably about 5 to 15 grams per liter, most preferably about 8 to 12 grams per liter.

The preferred concentration of hydrogen peroxide when it is used ranges from about 1 to 60 grams per liter, when preferably about 10 to 30 grams per liter, most preferably about 15 to 20 grams per liter.

The preferred concentration of aluminum nitrate when it is used is at about its saturation point, more preferably at about 65 to 70 grams per liter, most preferably 65 grams per liter.

Preferably, the electrolytic current density employed in the process of the present invention ranges from about 30 to about 120 Amps/square decimeter, more preferably about 45 to about 80 A/dm$^2$, most preferably about 45 to 60 A/dm$^2$.

The preferred electrolysis time ranges from about 20 seconds to about 3 minutes, more preferably 20 seconds to about 90 seconds, most preferably 20 seconds to about 60 seconds.

The distance from the aluminum surface to the inert electrode, which may preferably be graphite, chromium or lead, is preferably up to about 1.5 centimeters, more preferably from about 1 to 1.5 cm.

Graining is preferably conducted with alternating current. When alternating current is used, a frequency in excess of 55 Hz produces the best graining effect. A frequency of 60 to about 300 Hz is most preferred.

When a sheet of mill finished lithographic grade aluminum alloy such as Alcoa 3003, 1100 or Conalco A19 is electrolytically surface grained with only nitric acid at the above stated conditions, the resultant surface typically would show about a 40% increase in its surface area. The surface is relatively planar and is so soft that the plate must be anodized to harden it before it is useful for printing.

A sheet grained with an electrolyte containing 13 g/l nitric acid and 10 g/l boric acid and 65 g/l aluminum nitrate on the other hand would result in about a 300% increase in surface area over that of the mill finished sheet. The surface is sufficiently hard that anodizing is not necessary to produce a useful printing plate. However, it optionally may be anodized to enhance the plate's length of run. The graining forms pores which are slightly smaller than with nitric acid alone, but the walls have a much thicker construction. Furthermore, the surface is not planar but has a rolling appearance.

If about 8 g/l hydrogen peroxide is added to the 13 g/l nitric acid, 10 g/l boric acid and 65 g/l aluminum nitrate electrolyte, the surface has an approximately 700% increase in surface area over the mill finished aluminum. The surface demonstrates an extremely fine pore structure on a rolling surface. The pore walls are thick and demonstrate a sufficient hardness that anodizing is not necessary but may optionally be performed.

As the graining process continues, the aluminum surface inherently reacts with the nitric acid to produce aluminum nitrate. In order to stabilize and balance the amount of aluminum nitrate present throughout the continuous process, it is advantageous to add aluminum nitrate to the initial electrolytic solution. It is most advantageous if aluminum nitrate is present at its saturation point so that additional aluminum nitrate formed during the process would merely precipitate to the bottom of the processing tank while the solution concentration remains relatively constant.

After electrochemical graining, the sheet may optionally be anodized. This may be performed by passing the sheet through an anodizing bath containing, for example, sulfuric or phosphoric acid.

The preferred concentration of acid is from 10 to 20 weight %. The temperature of the anodizing bath is from 20° to 80° C. and best results are obtained if the temperature is from 20° to 40° C. Best results are also obtained if a direct current is impressed on the aluminum sheet in the anodizing bath and the current density should be in the range of from 1 to 100 amperes per square foot. The preferred current density is from 10 to 50 amperes per square foot. The anodizing step can be completed in from ½ to 3 minutes but usually this step takes no longer than 1 to 2 minutes.

In the production of lithographic printing plates, it is advantageous to subsequently treat the grained or grained and anodized plate with a hydrophilizing interlayer composition prior to coating with the lithographic photosensitizer. These interlayer treatments serve to better adhere the coating to the surface and also render the aluminum surface more hydrophilic. Typical interlayer treatments comprise polyvinyl phosphonic acid, sodium silicate, the alkali zirconium fluorides, such as potassium zirconium hexafluoride, and hydrofluozirconic acid disclosed in U.S. Pat. Nos. 3,160,506 and 2,946,683 are used for preparing aluminum bases to receive a light-sensitive coating.

Lithographically suitable photosensitive compositions typically comprise aromatic diazonium salts, quinone diazides and photopolymerizable compounds which are well known in the art. These are typically admixed with binding resins to extend the number of copies which a plate may reproduce. Examples of such binding resins include polyurethanes and phenol-formaldehyde resins among a wide variety of others as are well known in the art.

The invention is further illustrated by the following examples:

EXAMPLE #1

A section of Alcoa 1100 alloy aluminum was degreased with a conventional alkaline degreasing solution and immersed in a 1.5% (w/w) solution of nitric acid. Alternating current (60 Hz) was passed through the system where the aluminum was one electrode and lead sheet was the other. An electrode distance of 1.0 cm was maintained. A current density of 45 amps/dm$^2$ was employed for 60 seconds.

The resulting surface was analyzed with an SEM (Scanning Electron Microscope) at 1,000, 2,000 and 5,000 times magnification and found to be totally grained but in a very non-uniform way. Areas existed where extensive and undesired pitting occurred. Adjacent areas were more uniform but had pits with varying diameters. This surface had a 40% increase in surface area over the untreated aluminum. Such a surface has been found to be undesirable for quality printing.

EXAMPLE #2

A section of Alcoa 3003 alloy aluminum was prepared in like manner as described in Example #1. Similar results were obtained in that extensive pitting was observed using the SEM.

EXAMPLE #3

A section of Conalco A-19 alloy aluminum was prepared in like manner as described in Example #1. Similar results were obtained with the exception that the pitting was more extensive and severe.

EXAMPLE #4

A section of Alcoa 1100 alloy aluminum was degreased with a conventional alkaline degreasing solution and then immersed in an aqueous solution containing 1.5% (1%) nitric acid and 6.5% (w/w) aluminum nitrate. Alternating current was passed through the system where the aluminum was one electrode and lead sheet was the other. An electrode distance of 1.0 cm was maintained. A current density of 45 amps/dm$^2$ was employed for 60 seconds.

The sample was observed with the SEM and found to be grained somewhat uniformly. The surface was planar and had pores of varying sizes with rather thin walls. There was evidence of pitting. A 45% increase in surface area was measured as compared to untreated aluminum. For acceptable lithographic performance, this surface has to be anodized due to the fragility of the pores.

EXAMPLE #5

A section of Alcoa 3003 alloy aluminum was prepared in like manner as described in Example #4. Similar results were obtained in that the pores had varying sizes as well as pitting.

EXAMPLE #6

A section of Conalco A-19 alloy aluminum was prepared in like manner as described in Example #1. The surface was very undesirable due to non-uniformity of pore size in addition to some areas not grained and heavy pitting.

EXAMPLE #7

A section of Alcoa 1100 alloy aluminum was degreased with a conventional alkaline degreasing solution and then immersed in an aqueous solution containing 1.5% (w/w) nitric acid, 6.5% (w/w) aluminum nitrate and 1.0% (w/w) boric acid. Alternating current was passed through the system where the aluminum sample was one electrode and lead sheet was the other. An electrode distance of 1.0 cm was maintained. A current density of 45 amps/dm$^2$ was employed for 60 seconds. The samples were observed with the SEM and found to be extremely uniform. The surface was not planar, but rather now possessed a "grain". There were peaks and recessed areas which is novel when compared to other state-of-the-art methods. Further, the pores were extremely uniform in their distribution and diameter. Additionally, the walls of the pores were found to be thicker than previously observed. It was found that it was necessary to anodize after graining in order to have acceptable performance which is a radical departure from known systems. A 300% increase in surface area was measured as compared to untreated aluminum.

EXAMPLE #8

A section of Alcoa 3003 alloy aluminum was prepared in like manner as described in Example #7. Similar results were obtained in that the surface was very uniform.

EXAMPLE #9

A section of Conalco A-19 alloy aluminum was prepared in like manner as described in Example #7. Similar results were obtained in that the surface was very uniform.

EXAMPLE #10

A section of Alcoa 1100 alloy aluminum was degreased with a conventional alkaline degreasing solution and then immersed in an aqueous solution containing 1.5% (w/w) nitric acid, 6.5% aluminum nitrate, 1.0% (w/w) boric acid and 0.8% (w/w) hydrogen peroxide. Alternating current was passed through the system where the aluminum sample was one electrode and lead sheet was the other. An electrode distance of 1.0 cm was maintained. A current density of 45 Amps/dm$^2$ was employed for 60 seconds.

The samples were observed with the SEM. The uniformity and overall appearance was as described in Example #7. However, the pores were smaller and more numerous. At 10,000 times magnification, a phenomena not seen at lower magnifications was observed. For the first time, pores inside pores were created. As in Example #7, anodization was not necessary for a functional plate. A 700% increase in surface area was measured as compared to untreated aluminum.

EXAMPLE #11

A section of Alcoa 3003 alloy aluminum was prepared in like manner as described in Example #7. Similar results were obtained in that the surface was very uniform.

EXAMPLE #12

A section of Conalco #19 alloy aluminum was prepared in like manner as described in Example #7. Similar results were obtained in that the surface was very uniform.

What is claimed is:

1. A method of treating the surface of a sheet of aluminum or the alloys thereof which comprises electrolytically graining said sheet under electrolyzing conditions in an aqueous solution containing at least about 3 gram/liter of nitric acid and from about 1 gram/liter to about the saturation point of boric acid for a sufficient length of time to provide a finely grained surface topography to said sheet.

2. The method of claim 1 wherein the concentration of nitric acid ranges from about 3 grams/liter to about 20 grams/liter.

3. The method of claim 1 wherein said aqueous solution further comprises hydrogen peroxide.

4. The method of claim 3 wherein said aqueous solution further comprises aluminum nitrate.

5. The method of claim 1 wherein said aqueous solution further comprises aluminum nitrate.

6. The method of claim 1 wherein the current density employed in said electrolytic graining ranges from about 30 to about 120 A/dm$^2$.

7. The method of claim 1 wherein said electrolytically grained sheet is subsequently anodized.

8. The aluminum sheet prepared according to claim 1, 2, 3, 4, 5, 6 or 7.

9. The aluminum sheet prepared according to claim 1 or 7 which has a hydrophilizing composition coated on at least one surface thereof.

10. A lithographic printing plate which comprises the aluminum sheet prepared according to the method of claim 1 or 7 and a lithographic photosensitive composition coated on at least one surface of said sheet.

11. A lithographic printing plate comprising the sheet of claim 9 and a lithographic photosensitive composition coated on said hydrophilizing composition.

* * * * *